US006760553B2

(12) United States Patent
Mitsuya et al.

(10) Patent No.: US 6,760,553 B2
(45) Date of Patent: Jul. 6, 2004

(54) ELECTROPHOTOGRAPHIC CLUSTER PRINTING SYSTEM WITH CONTROLLED IMAGE QUALITY

(75) Inventors: Teruaki Mitsuya, Ibaraki (JP); Keisuke Kubota, Ibaraki (JP); Masayoshi Ishii, Ibaraki (JP); Shintaro Yamada, Ibaraki (JP)

(73) Assignees: Hitachi Printing Solutions, Ltd., Ebina (JP); Hitachi, Ltd., Tokyo (JP)

( * ) Notice: Subject to any disclaimer, the term of this patent is extended or adjusted under 35 U.S.C. 154(b) by 0 days.

(21) Appl. No.: 10/329,756

(22) Filed: Dec. 27, 2002

(65) Prior Publication Data

US 2003/0128993 A1 Jul. 10, 2003

(30) Foreign Application Priority Data

Dec. 28, 2001 (JP) ..... P.2001-400307
Dec. 6, 2002 (JP) ..... P.2002-355329

(51) Int. Cl.[7] ..... G03G 15/00
(52) U.S. Cl. ..... 399/38; 399/49; 399/55
(58) Field of Search ..... 399/38, 44, 46, 399/48, 49, 53, 55, 66

(56) References Cited

U.S. PATENT DOCUMENTS 6,058,275 A * 5/2000 Kodama ..... 399/46

FOREIGN PATENT DOCUMENTS

JP 04-146459 5/1992
JP 11-015214 1/1999

* cited by examiner

*Primary Examiner*—Hoang Ngo
(74) *Attorney, Agent, or Firm*—McGinn & Gibb, PLLC

(57) ABSTRACT

An electrophotographic cluster printing system for performing printing by using a plurality of electrophotographic recording apparatuses such as printers, facsimile machines or copying machines each capable of manifesting an image by using colored particles such as toner. The electrophotographic cluster printing system includes a plurality of electrophotograhic recording apparatuses each including a photoconductor, a charger, an exposure device, a developing device, and an image quality controller for detecting a factor concerning image quality and controlling image quality of an output image on the basis of information of the detected factor. In the system, at least two of the electrophotograhic recording apparatuses is used for printing one job and image quality of any one of the electrophotograhic recording apparatuses is controlled on the basis of detected information of the other electrophotograhic recording apparatuses.

18 Claims, 5 Drawing Sheets

ELECTROPHOTOGRAPHIC CLUSTER PRINTING SYSTEM WITH CONTROLLED IMAGE QUALITY

BACKGROUND OF THE INVENTION

1. Field of the Invention

The present invention relates to a cluster printing system for performing printing by using a plurality of electrophotographic recording apparatuses such as printers, facsimile machines or copying machines each capable of manifesting an image by using colored particles such as toner. Particularly, it relates to an image quality control method in an imaging and fixing process having electrification, exposure, development, transfer and fixation for forming a toner image on surfaces of a photoconductor and a sheet of recording paper, recording apparatuses using the image quality control method, and a method for operating the recording apparatuses.

2. Background Art

A conventional recording apparatus using electrophotography has an imaging process for manifesting an image of colored particles on a surface of a recording medium, and a fixing process for fixing the manifested image of colored particles on the recording medium. In this specification, a combination of the imaging process and the fixing process is referred to as imaging engine. Powder called "toner" exclusively used for electrophotography is used as the colored particles. In an electrifying step, the whole surface of a photoconductor is once electrically charged. Then, in an exposure step, the photoconductor irradiated with light is partially electrically discharged. On this occasion, potential contrast between a charged region and a discharged region is formed in the surface of the photoconductor. The potential contrast is referred to as "electrostatic latent image".

In the next developing step, first, toner particles which are colored particles are electrically charged. As methods for electrically charging toner, there are a two-component developing method using carrier beads and a one-component developing method for electrically charging toner on the basis of friction between the toner and a member or the like. On the other hand, a method called "bias development" is often used as a method for manifesting the electrostatic latent image.

In the bias development, a bias voltage is applied to a developing roller so that electrostatically charged toner particles are separated from a developing agent on a surface of the developing roller and moved to the surface of the photoconductor by the action of electric field generated between latent image potential generated on a surface of a photoconductor and the potential of the developing roller to thereby form an image. Either the electrostatic charge potential or discharge potential may be used as the latent image potential, that is, as the potential of the image-forming portion of the photoconductor. Generally, the method using electrostatic charge potential as the latent image potential is referred to as "normal developing method" whereas the method using discharge potential as the latent image potential is referred to as "reversal developing method".

Potential which is either of the electrostatic charge potential and the discharge potential but is not used as the latent image potential is referred to as "background potential". The bias voltage of the developing roller is set to have potential middle between the electrostatic charge potential and the discharge potential. Similarly, the difference between the middle potential (bias voltage) and the latent image potential is referred to as "developing potential difference". The difference between the middle potential (bias voltage) and the background potential is referred to as "background potential difference". Generally, the developing potential difference having an influence on developing performance itself is set to be larger than the background potential difference. It is a matter of course that if the developing potential difference is large, developing performance becomes high because generated electric field (referred to as "developing electric field") becomes intensive.

On the other hand, the background potential difference has an influence on the image quality of a background portion of an image. If the background potential difference is small, fogging of the background portion increases. If the background potential difference is too large, a rear end portion of the image in a direction of rotation of the developing roller is apt to be chipped. The direction of relative movement of the developing roller and the direction of relative movement of the photoconductor may be equal to each other or may be different from each other.

A plurality of developing rollers may be used in one developing device. A developing device having a plurality of developing rollers rotating in one direction may be provided or a developing device having a plurality of developing rollers rotating indifferent directions may be provided. In this case, there is also known a developing device in which the directions of rotation of adjacent developing rollers are made different to move the two developing rollers from their opposite positions toward the photoconductor so that the developing agent is carried toward the photoconductor while branching from the opposite positions of the developing rollers as if the developing agent was a fountain. The developing device is referred to as "fountain type developing device". The formation of an electrostatic latent image and a toner image on a surface of the photoconductor has been described above.

Next, variation of the electrostatic latent image on the surface of the photoconductor with time will be described. When the photoconductor deteriorates as printing increases in quantity, the potential of an electrostatic charge region (charge potential) is so lowered that the electrostatic charge region can be hardly charged while the potential of a discharge region (discharge potential) is so heighten that the discharge region can be hardly discharged. The lowering of the discharging capacity is significant in the case where an intermediate potential region is provided so that the intermediate potential region is not perfectly discharged because a sufficient quantity of light is not given at exposure.

The intermediate potential region described here is often used for preventing thickening of an image region such as a thin line region or a halftone dot region in which the edge effect of electric field is so intensive that toner is developed excessively. The variation in potential operates to reduce developing electric field because it reduces the developing potential difference. On the other hand, in addition to this characteristic, the thickness of the photosensitive layer of the photoconductor is reduced by abrasion as printing increases in quantity. The reduction of the film thickness operates to increase the developing electric field. Which of the two antithetical tendencies is predominant varies in accordance with the printing apparatus.

That is, though image quality varies in accordance with variation with time in developing capacity, how the image quality varies depends on the printing apparatus. Reduction of variation in the developing electric field is required for keeping image quality constant with time. For this reason, it is necessary to consider variation in potential and electric field on the surface of the photoconductor.

There is known a method in which the potential on the surface of the photoconductor is detected by a potential sensor and the film thickness of the photoconductor is detected by some method to control the potential on the surface of the photoconductor to keep the developing electric field constant. For example, the related art concerning a method of controlling the surface potential of the photoconductor in consideration of the influence of the electric field has been described in JP-A-11-15214.

Variation in charge density of toner in the developing device is a main cause of variation in image quality as well as variation with time in potential and electric field of the electrostatic latent image on the surface of the photoconductor is a main cause thereof. Hence, there is also known a method for keeping image quality stable by using feedback control to adjust the developing bias voltage on the basis of the detected value of toner mass deposited on the photoconductor. For example, the related art concerning a method of controlling deposited toner mass stably has been described in JP-A-4-146459.

SUMMARY OF THE INVENTION

As described above, image quality control (hereinafter referred to as "image quality stabilizing control") in the related art is made for keeping image quality constant with time in one recording apparatus but there is no consideration about image quality difference between recording apparatuses in the case where, for example, two or more recording apparatuses are used for outputting continuous printed matter.

If two or more printing apparatuses are used for obtaining one continuous printed matter, there arises a problem that image quality varies discontinuously in different pages printed by the recording apparatuses. The term "continuous printed matter" used here in means printed matter such as a booklet having different sheets of recording paper but having relevant contents in front and rear pages and recognized as one object by a user requiring information written in the printed matter. The continuous printed matter is referred to as "job" in this specification. Printing of one job by two or more recording apparatuses is referred to as "cluster printing" in this specification. Incidentally, one recording apparatus in this specification is constituted by one imaging engine. For example, two imaging engines may be connected to each other and put as one apparatus into a casing. Even in this case, the two imaging engines are regarded as two recording apparatuses persistently in this specification.

An object of the invention is to provide an electrophotographic printing system in which image quality in one job is prevented from varying discontinuously even in the case where cluster printing is made.

In order to suppress image quality difference between a plurality of electrophotographic recording apparatuses, in accordance with the invention, image quality stabilizing control is applied to each of the electrophotographic recording apparatuses in such a manner that a certain electrophographic recording apparatus is used so that image quality of the other electrophotographic recording apparatuses is controlled on the basis of detected information of the certain electrophotographic recording apparatus.

DETAILED DESCRIPTION OF THE PREFERRED EMBODIMENTS (Embodiment 1)

Figure 1:
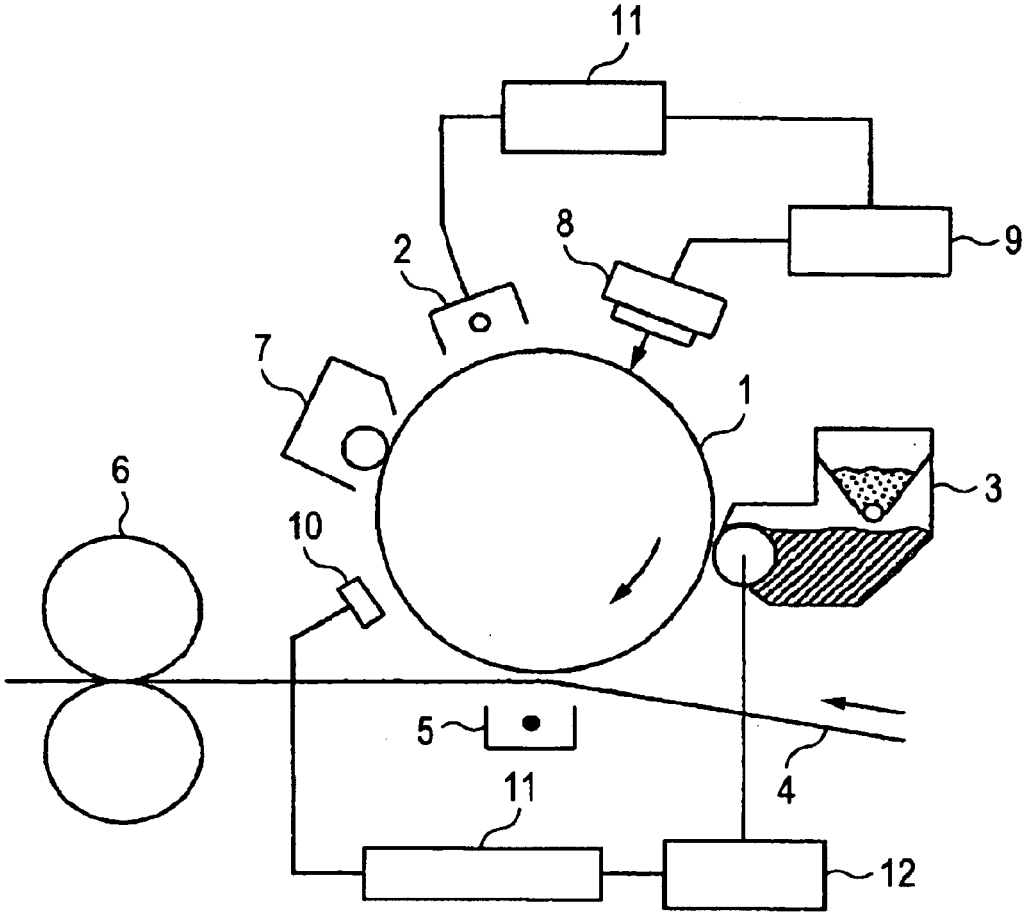
FIG. 1 is a typical diagram showing a section of a recording apparatus according to Embodiment 1.

An embodiment of the invention will be described below with reference to FIGS. 1 through 3. In a printing system according to this embodiment, two electrophotographic recording apparatuses A and B which are the same in configuration are used for printing one job. FIG. 1 is a typical diagram showing a section of each of the recording apparatuses used in this embodiment. Each of the recording apparatuses has a photoconductor drum 1, a charger 2, a developing device 3, a sheet of recording paper 4, a transferring device 5, a fixing device 6, a cleaner 7, an exposure device 8, an exposure control unit 9, a deposited toner mass sensor 10, a deposit mass control board 11, and a developing bias voltage source 12.

The exposure device 8 has a semiconductor laser, and an optical system for the semiconductor laser. The exposure control unit 9 has a laser driver or the like. Light emission from the semiconductor laser is controlled by the exposure control unit 9. An electrostatic latent image is formed, by the exposure device 8, on a surface of the photoconductor drum 1 evenly electrostatically charged by the charger 2. Then, toner is developed by the developing device 3.

The toner developed on the surface of the photoconductor drum 1 is transferred onto the sheet of recording paper 4 by the transferring device 5. Then, the toner image transferred thus is heat-fused and fixed onto the sheet of recording paper 4 by the fixing device 6. On the other hand, the residual part of toner not transferred but remaining on the surface of the photoconductor drum 1 is collected by the cleaner 7. Thus, a series of processes is terminated.

A scorotron type charger 2 is used for electrification. Generally, chargers are classified into two types, that is, corotron type and scorotron type. Because a grid is used in the scorotron type charger, charge density supplied to the surface of the photoconductor changes automatically so that charge potential is kept constant in spite of deterioration of the photoconductor or variation in film thickness of the photoconductor. As a result, the scorotron type charger has an advantage that charge potential just under the charger is relatively stable.

Variation of the electrostatic latent image on the surface of the photoconductor with time will be first described. When the photoconductor deteriorates as printing increases in quantity, the potential of the charge region (charge potential) is so lowered that the charge region can be hardly charged electrically, that is, the background potential is lowered. In this embodiment, the lowering of the background potential is however slight because the scorotron type charger is used as the charger 2.

On the other hand, the potential of the discharge region (discharge potential) is so heightened that the discharge region can be hardly discharged electrically. Because the variation in potential reduces the developing potential difference, developing capacity, that is, deposited toner mass (image density) is lowered. The variation in potential on the photoconductor is influenced not only by the aforementioned deterioration but also by variation in temperature and humidity.

The deposited toner mass varies dependently not only on variation in potential of the photoconductor but also on variation in characteristic such as charge quantity of the developing agent caused by variation or deterioration in the environmental condition. Therefore, in each of the recording apparatus used in this embodiment, a method using the deposit mass sensor 10 for controlling the deposit mass itself to be stable is adopted so that an image can be stabilized in response to the two variation factors of variation in potential of the photoconductor and variation in characteristic such as charge quantity of the developing agent.

A bias developing method using reversal development is used as the developing method in this embodiment. A bias voltage is applied to the developing roller which is one of constituent parts in the developing device 3, so that electrostatically charged toner particles are separated from the developing agent on the surface of the developing roller and moved to the surface of the photoconductor by the action of electric field generated between the latent image potential generated on the surface of the photoconductor and the potential of the developing roller to thereby form an image.

For reversal development, discharge potential is used as the latent image potential (the potential of an image-forming portion of the photoconductor). The bias voltage of the developing roller is set to be middle between the charge potential and the discharge potential. The difference between the middle potential (bias voltage) and the discharge potential is a developing potential difference. As the developing potential difference becomes larger, the deposited toner mass can become larger.

In this embodiment, the developing potential difference is controlled on the basis of the detected deposit mass so that the deposit mass can be kept stable with time. Incidentally, the term "deposited toner mass" used herein means the mass of developed toner per unit area of the surface of the photoconductor 1 in the condition that the toner has been not transferred yet after the developing process. Accordingly, the deposited toner mass has one-to-one correspondence with image density on the photoconductor 1. The deposited toner mass also has one-to-one correspondence with image density on printed matter if the influence of transfer and fixation such as transfer efficiency on the developed image can be kept constant.

In this embodiment, the deposit mass sensor 10 is disposed as a step after the transferring device 5. When detection is required, however, a patch exclusively used for detection of the deposit mass is printed and passes through the transferring device 5 in the condition that a current supplied to the transferring device 5 is interrupted. After the detection of the deposit mass is completed, the patch is swept by the cleaner 7.

In the printing system according to this embodiment, there can be used two kinds of operating modes, that is, a mode using one recording apparatus for printing one job and a mode using two recording apparatuses for printing one job. In this specification, the former is referred to as "single mode" and the latter is referred to as "cluster mode". As described above, a subject of the invention is printed matter such as a booklet having contents different in page but relevant to one another between front and rear pages, in which information written in the printed matter is recognized as one kind of information by a user requiring the information. In this specification, the continuous printed matter is referred to as "job".

Figure 2:
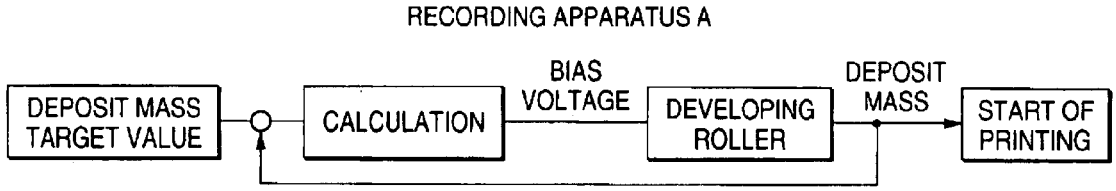
FIG. 2 is a sequence diagram showing a control sequence in a single mode.

FIG. 2 shows a control sequence in the single mode. In the single mode, each of recording apparatuses A and B is used as one recording apparatus independently. The control sequence shown in FIG. 2 applies to each of the recording apparatuses A and B. A detection signal of the deposit mass sensor 10 is sent to the deposit mass control board 11 and compared with a deposit mass target value set in advance. When a decision is made that the detected value is smaller than the target value, the bias voltage is changed in a direction of increasing the developing potential difference. On the other hand, when a decision is made that the detected value is larger than the target value, the bias voltage is changed in a direction of decreasing the developing potential difference.

Because variation in image quality can be suppressed within an allowable variation range by this control when each of the recording apparatuses A and B is used in the single mode, image quality stable with time can be obtained. That is, even in the single mode, there is an image quality difference between the maximum and the minimum in the allowable variation range with the passage of time. The difference is however very slight in between adjacent pages, so that the image quality difference cannot be discriminated. When, for example, the image quality difference exceeds the allowable variation range through 10000 pages, the difference between image quality at the first page and image quality at the last page can be discriminated clearly but the image quality difference between adjacent pages cannot be discriminated clearly. Accordingly, there is no sense of incompatibility given to a reader who reads left and right opened pages of the booklet held in his or her hands.

Assume next the case where printing is made by two recording apparatuses in the cluster mode without having any interference control between the two recording apparatuses though deposit mass in each recording apparatus is feedback-controlled independently in the same manner as in the single mode. When, for example, a certain job is performed in such a manner that pages 1 (front), 2 (rear), 5 (front), 6 (rear), 9 (front) and 10 (rear) are printed in page order on opposite surfaces of sheets of recording paper by one recording apparatus A while pages 3 (front), 4 (rear), 7 (front), 8 (rear), 11 (front) and 12 (rear) are printed in page order on opposite surfaces of sheets of recording paper by the other recording apparatus B, a set of continuous pages such as a set of pages 1 and 2 or a set of pages 7 and 8 are printed on opposite surfaces of one sheet of recording paper by either of the recording apparatuses A and B.

When these pages are bound into a booklet, the image quality difference between the maximum and the minimum in the allowable variation range may be produced at maximum to give a sense of incompatibility to a reader because a pair of opened pages such as a pair of pages 2 and 3, a pair of pages 4 and 5, a pair of pages 6 and 7, a pair of pages 8 and 9 or a pair of pages 10 and 11 are printed by the different recording apparatuses A and B. In order to solve this problem, in the printing system according to this embodiment, the recording apparatus A is used as a mother recording apparatus so that a target value in the recording apparatus B can be set on the basis of deposit mass-detected information of the recording apparatus A.

Figure 3:
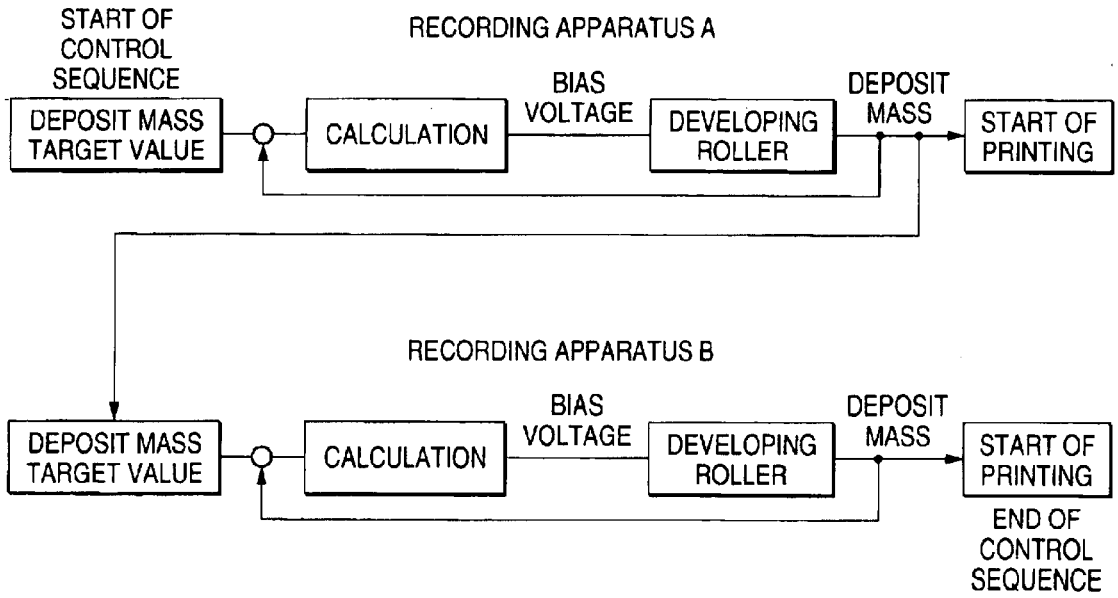
FIG. 3 is a sequence diagram showing a control sequence in a cluster mode in Embodiment 1.

FIG. 3 shows a control sequence in the cluster mode. First, deposit mass is detected in the recording apparatus A at predetermined timing, so that feedback control to a predetermined control target value is performed on the basis of the detected deposit mass. Generally, the deposit mass in the recording apparatus A is decided at a point of time when feedback is performed twice or three times. Thus, a control sequence for the recording apparatus A is completed.

The deposit mass value (the lass deposit mass value in a series of detection) detected at the time of completion of the control sequence for the recording apparatus A is sent to the recording apparatus B immediately after it is confirmed that the recording apparatus A starts an ordinary printing operation. The deposit mass value is set as a target value in a control sequence for the recording apparatus B.

The recording apparatus B starts the control sequence to control the deposit mass appropriately in accordance with the target value immediately after the deposit mass target value is received from the recording apparatus A. On this occasion, printing by the recording apparatus A is not interrupted because the recording apparatus A has already started the ordinary printing operation.

As described above, in accordance with this embodiment, image quality stable with time can be obtained in the single mode because deposit mass is controlled in each of the recording apparatuses A and B independently. Moreover, there is no image quality difference produced between the recording apparatuses A and B in the cluster mode because the value detected in the recording apparatus A is used as a target value for the recording apparatus B. Even in the case where pages printed by the recording apparatuses A and B in the cluster mode are bound into a booklet, discontinuous variation in image quality can be eliminated.

In addition, because the recording apparatus B continues printing while the recording apparatus A executes the control sequence, and because the recording apparatus A starts printing while the recording apparatus B executes the control sequence, there is also an effect that printing is not interrupted.

(Embodiment 2)

Figure 4:
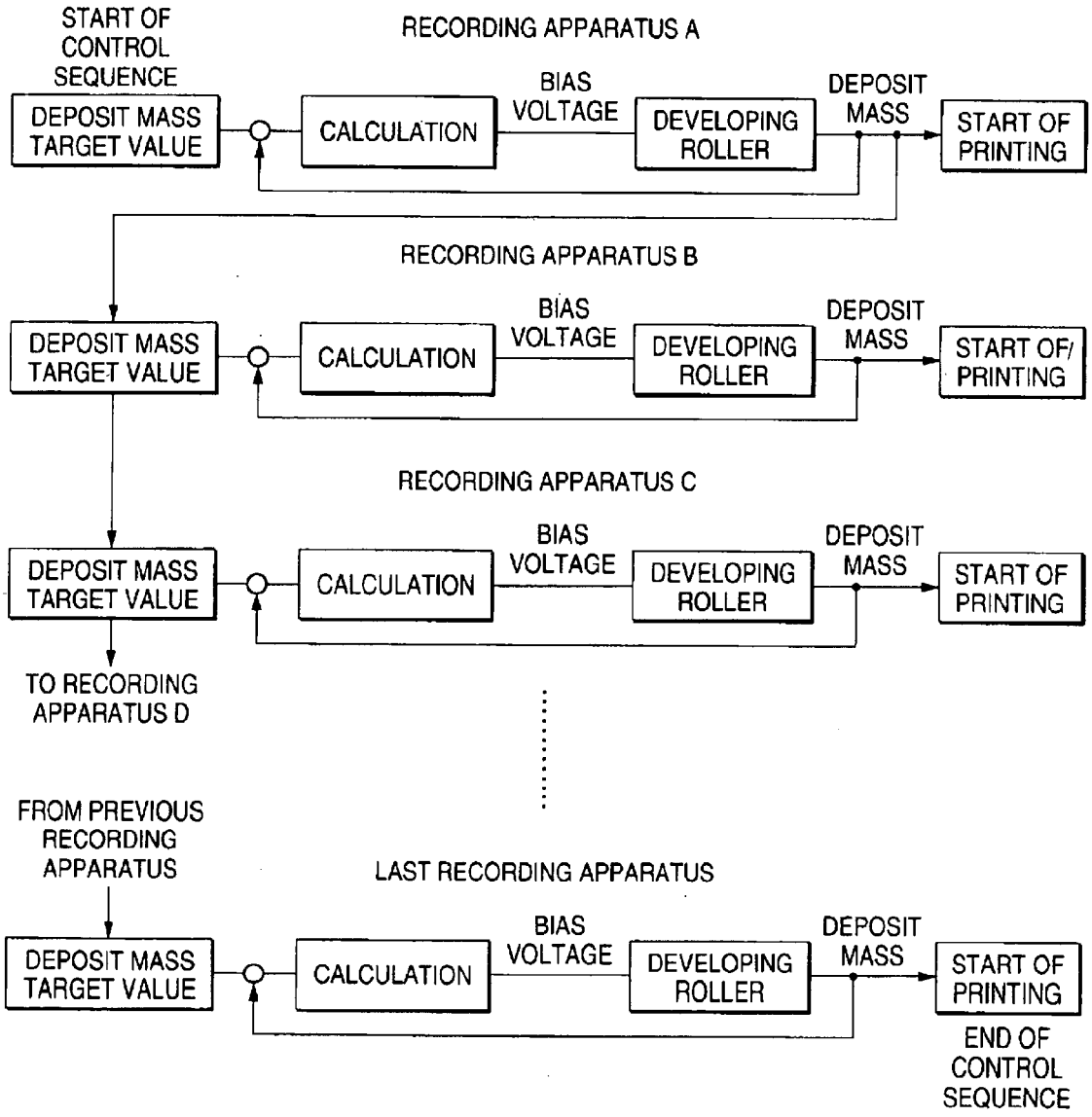
FIG. 4 is a sequence diagram showing a control sequence in a cluster mode in Embodiment 2.

Next, another embodiment of the invention will be described with reference to FIG. 4. This embodiment shows a printing system having 3 to N recording apparatuses. Recording apparatuses A, B, C, . . . are used. The recording apparatus A is used as a mother recording apparatus. Each of the recording apparatuses as to hardware configuration and operation is the same as described in Embodiment 1 with reference to FIG. 1.

The control sequence in the single mode is the same as described in Embodiment 1 with reference to FIG. 2. FIG. 4 shows a control sequence in the cluster mode. First, deposit mass in the recording apparatus A is detected at predetermined timing. Feedback control for a predetermined control target value is performed. Thus, the control sequence in the recording apparatus A is completed in the same manner as in Embodiment 1.

Then, the value of deposit mass (the last value of deposit mass in a series of detection) detected at the time of completion of the control sequence in the recording apparatus A is sent to the recording apparatus B immediately after it is confirmed that the recording apparatus A starts an ordinary printing operation. The value of deposit mass is set as a target value for a control sequence in the recording apparatus B. The recording apparatus B starts the control sequence to control the deposit mass appropriately in accordance with the target value immediately after the deposit mass target value is received from the recording apparatus A. This procedure is also the same as in Embodiment 1.

Then, the detected value of the recording apparatus A set as a target value by the recording apparatus B is sent to the recording apparatus C immediately after it is confirmed that the recording apparatus B starts an ordinary printing operation. In the recording apparatus C, this value is set as a target value in a control sequence. The recording apparatus C starts the control sequence to control the deposit mass appropriately in accordance with the target value immediately after the deposit mass target value is received from the recording apparatus B. This series of operations for delivering the detected value of the recording apparatus A and executing the control sequence in each recording apparatus are carried out successively on the recording apparatuses B, C, D, . . . After the control sequence in the last recording apparatus is completed, delivery of the detected value is not performed any more.

As described above, in accordance with this embodiment, image quality stable with time can be obtained in the single mode because each of the recording apparatuses performs deposit mass control independently. Moreover, there is no image quality difference between the recording apparatuses in the cluster mode because the detected value of the recording apparatus A is used as a target value common to the recording apparatus B and recording apparatuses following the recording apparatus B. Even in the case where pages printed by the recording apparatuses in the cluster mode are bound into a booklet, discontinuous variation in image quality can be eliminated. In addition, while one recording apparatus executes the control sequence, another recording apparatus performs printing. Hence, no interruption of printing is generated. There is an effect that reduction in throughput can be minimized.

(Embodiment 3)

Figure 5:
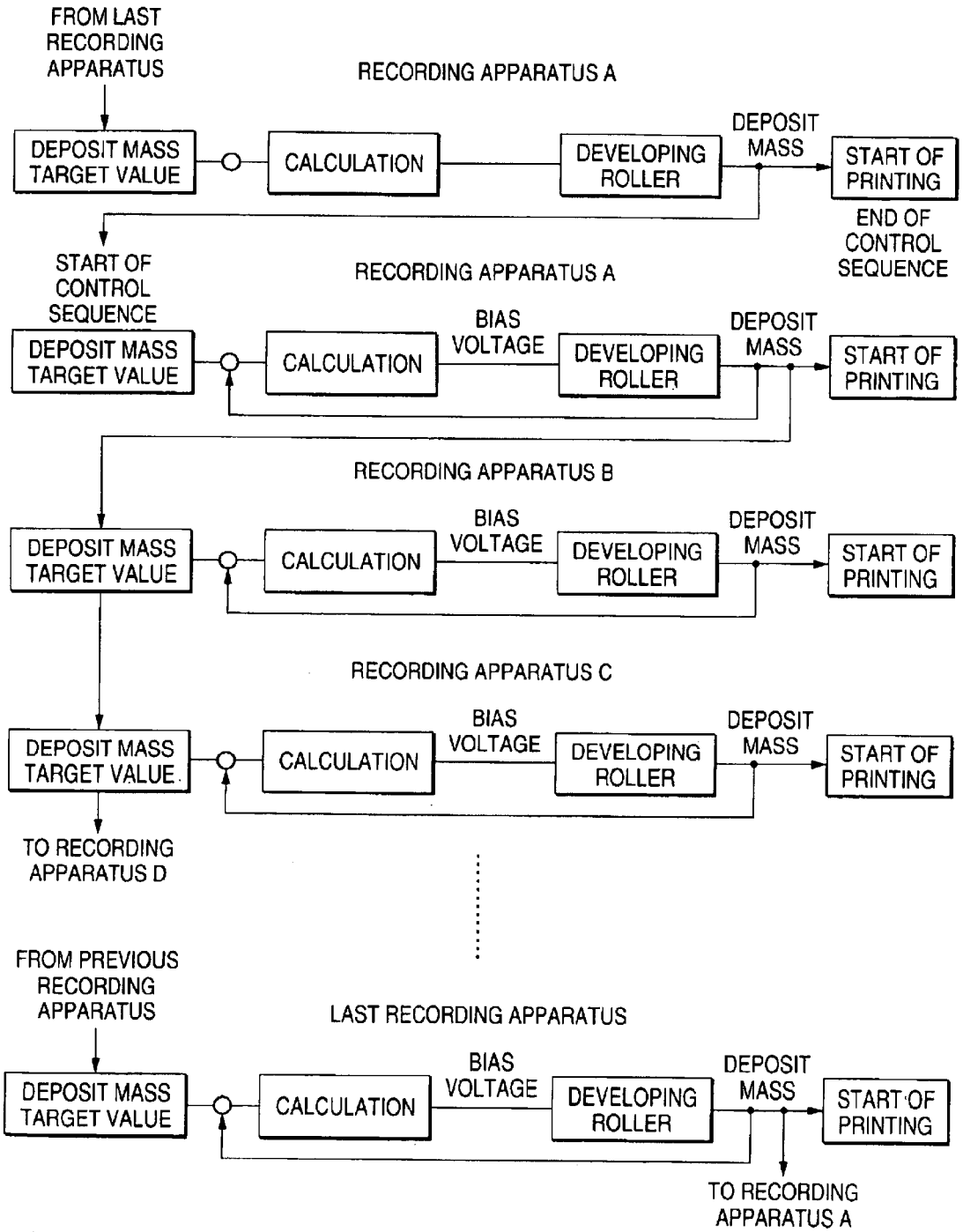
FIG. 5 is a sequence diagram showing a control sequence in a cluster mode in Embodiment 3.

A further embodiment of the invention will be described with reference to FIG. 5. This embodiment is effective in a printing system having two to N recording apparatuses. Each of the recording apparatuses as to hardware configuration and operation is the same as described in Embodiment 1 with reference to FIG. 1. The control sequence in the single mode is the same as described in Embodiment 1 with reference to FIG. 2. FIG. 5 shows a control sequence in the cluster mode in the printing system according to this embodiment. The control sequence in this embodiment is the same as the sequence shown in FIG. 4 in that the detected value of the recording apparatus A as a mother recording apparatus is delivered to the last recording apparatus and used as a control target value for starting the control sequence immediately to control the deposit mass appropriately in accordance with the target value. The value of deposit mass (the last value of deposit mass in a series of detection in the last recording apparatus) detected at the time of completion of the control sequence in the last recording apparatus is delivered to the mother recording apparatus A immediately after the last recording apparatus completes the control sequence and starts a printing operation.

The recording apparatus A detects deposit mass immediately. The value of deposit mass detected by the recording apparatus A at that time is compared with the detected value delivered from the last recording apparatus to the recording apparatus A. If an allowable difference set in advance is satisfied, a decision is made that the control sequence in the printing system as a whole is completed. All the control sequence is then interrupted until the next timing set in advance comes. If the difference between the two values is larger than the allowable difference, the printing system as a whole re-starts the control sequence so that a series of control sequences in the respective recording apparatuses are repeated.

As described above, in accordance with this embodiment, when the number of recording apparatuses is large, there is an effect that a difference is prevented from being produced between image quality of a higher-rank recording apparatus and image quality of a lower-rank recording apparatus when the target value which has been set already is influenced by a main cause of disturbance while a sequence for stabilizing deposit mass in each recording apparatus is operated.

Moreover, while one recording apparatus executes the control sequence, another recording apparatus performs printing. Hence, no interruption of printing is generated. It is a matter of course that there is an effect that reduction in throughput can be minimized.

(Embodiment 4)

Figure 6:
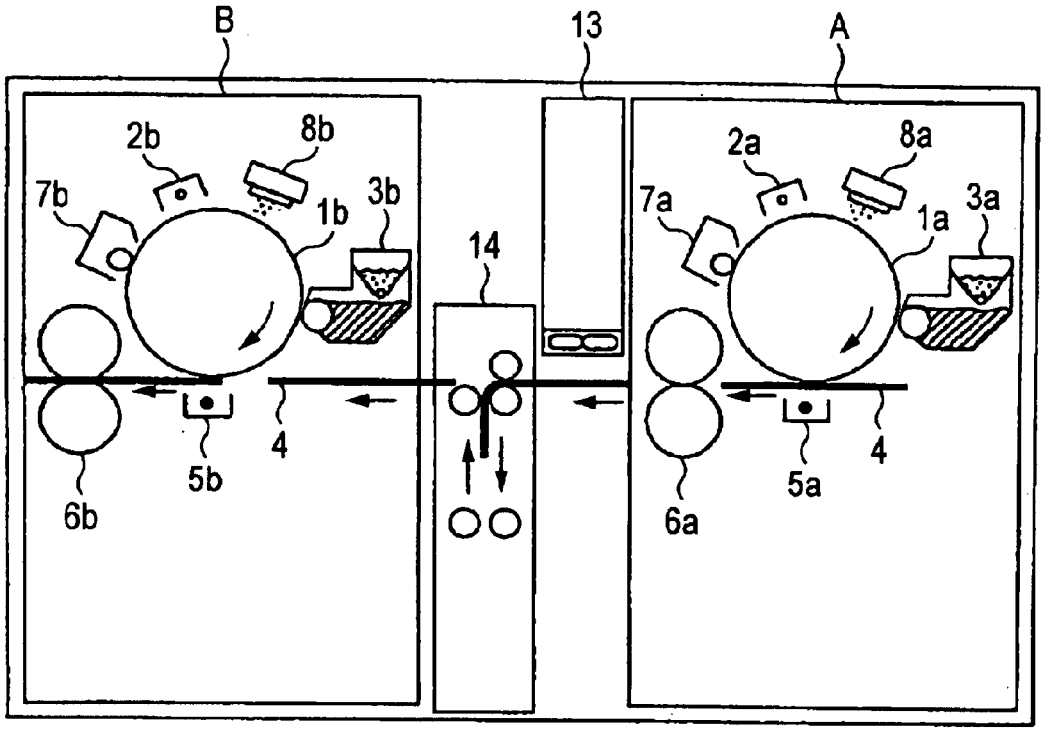
FIG. 6 is a typical diagram showing a section of a tandem type recording system.

A further embodiment of the invention will be described below with reference to FIG. 6. FIG. 6 is a diagram typically showing a section of a tandem type recording system according to this embodiment. In this embodiment, the recording system has two imaging engines which are the same in configuration and which are connected to each other in the form of a tandem for printing one job. The two imaging engines are A on the upstream side and B on the downstream side. Front surfaces (odd-number pages) of sheets of recording paper are printed by the imaging engine A whereas rear surfaces (even-number pages) of sheets of recording paper are printed by the imaging engine B. Although the two imaging engines are put into a casing, the two imaging engines are regarded as two recording apparatuses in the definition of this specification.

In the recording system having the imaging engines A and B, the reference numerals 1*a* and 1*b* designate photoconductor drums; 2*a* and 2*b*, chargers; 8*a* and 8*b*, exposure devices; 3*a* and 3*b*, developing devices; 4, a sheet of recording paper; 5*a* and 5*b*, transferring devices; 6*a* and 6*b*, fixing devices; 7*a* and 7*b*, cleaners; 13, a paper cooling unit; and 14, a turnover unit. In each reference numeral, the symbol a shows a device included in the imaging engine A for forming an image on the first surface, and the symbol b shows a device included in the imaging engine B for forming an image on the second surface. For example, the reference numeral 1*a* designates a photoconductor drum for the first surface while the reference numeral 1*b* designates a photoconductor drum for the second surface. The exposure device 8*a* has a semiconductor laser, and an optical system for the semiconductor laser. Light emission from the semiconductor laser is controlled by an exposure control unit having a laser driver or the like. To form an image on the first surface, a surface of the photoconductor drum 1*a* is evenly electrically charged by the charger 2*a* of the imaging engine A. Thus, an electrostatic latent image is formed on the surface of the photoconductor drum 1*a* by the exposure device 8*a*. Then, toner is developed by the developing device 3*a*.

The toner developed on the surface of the photoconductor drum 1*a* is transferred onto the front surface (odd-number page) of the sheet of paper 4 by the transferring device 5*a*. Then, the toner image thus transferred is heat-fused and fixed onto the first surface of the sheet of paper 4 by the fixing device 6*a*. On the other hand, the residual part of toner not transferred but remaining on the surface of the photoconductor drum 1*a* is collected by the cleaner 7*a*. Thus, the process of forming an image on the first surface is completed.

Then, the sheet of paper 4 is cooled by the paper cooling unit 13 so that the photoconductor 1*b* can be prevented from being thermally damaged at the time of transfer to the rear surface (even-number page). After cooling, the sheet of paper 4 reaches the switchback type turnover unit 14, so that the sheet of paper 4 is reversed downside up with its rear surface facing upward. The imaging engine B for forming an image on the rear surface (even-number page) operates in the same manner as the imaging engine A for forming an image on the front surface (odd-number page). That is, an image for the rear surface (even-number page) is formed on the photoconductor 1*b*. After fixation on the front surface (odd-number page), cooling and turnover are completed, the toner image for the rear surface (even-number page) is transferred onto the sheet of paper 4 having the rear surface (even-number page) reversed to face upward, by the transferring device 5*b*.

For example, assume that a certain job is performed in such a manner that pages 1 (front), 3 (front), 5 (front), 7 (front), 9 (front) and 11 (front) are printed in page order on front surfaces of sheets of recording paper by the imaging engine A while pages 2 (rear), 4 (rear), 6 (rear), 8 (rear), 10 (rear) and 12 (rear) are printed in page order on rear surfaces of the sheets of recording paper by the other imaging engine B. When the pages are bound into a booklet, a pair of opened pages such as a pair of pages 2 and 3, a pair of pages 4 and 5, a pair of pages 6 and 7, a pair of pages 8 and 9 or a pair of pages 10 and 11 are printed by the different imaging engines A and B. For this reason, an image quality difference may be produced between the pair of opened pages to give a sense of incompatibility to a reader.

In order to solve this problem, in the printing system according to this embodiment, the imaging engine A is used as a mother recording apparatus so that a target value for the imaging engine B can be set on the basis of deposit mass-detected information received from the imaging engine A. The control sequence for controlling the deposit mass is the same as shown in FIG. 3. That is, first, deposit mass is detected in the imaging engine A at predetermined timing, so that feedback control to a predetermined control target value is performed on the basis of the detected deposit mass.

Generally, the deposit mass in the imaging engine A is decided at a point of time when feedback is performed twice or three times. Thus, the control sequence for the imaging engine A is completed. The deposit mass value (the last deposit mass value in a series of detection) detected at the time of completion of the control sequence for the imaging engine A is sent to the imaging engine B immediately. The deposit mass value is set as a target value in a control sequence for the imaging engine B.

The imaging engine B starts the control sequence to control the deposit mass appropriately in accordance with the target value immediately after the deposit mass target value is received from the imaging engine A. Then, both the imaging engines A and B start ordinary printing operations.

As described above, in accordance with this embodiment, in a recording system having two imaging engines connected to each other in the form of a tandem for performing double-side printing, the image quality difference between the imaging engines A and B is eliminated. Hence, even in the case where pages printed by the imaging engines A and B are bound into a booklet, discontinuous variation in image quality can be eliminated.

As described above, in accordance with the invention, image quality stabilizing control is applied to each of a plurality of recording apparatuses in order to suppress image quality difference between the recording apparatuses. Information detected in a certain recording apparatus is used so that image quality in another recording apparatus is controlled on the basis of the detected information of the certain recording apparatus. Hence, the image quality difference between the recording apparatuses used in cluster printing can be eliminated, so that there can be provided an electrophotographic printing system in which image quality in one job can be prevented from varying discontinuously even in the case where cluster printing is made.

What is claimed is:

1. An electrophotographic cluster printing system, comprising:

a plurality of electrophotographic recording apparatuses, each of the plurality of electrophotographic recording apparatuses, including:

a photoconductor;

a charger;

an exposure device;

a developing device; and an image quality controller for detecting a factor concerning image quality and controlling the image quality of an output image based on information about the factor, wherein a first and a second recording apparatus is used for printing one job and the image quality of the second electrophotographic recording apparatus is controlled by the information of the first electrophotographic recording apparatus.

2. An electrophotographic cluster printing system, comprising:

a plurality of electrophotographic recording apparatuses, each of the plurality of electrophotographic recording apparatuses, including;

a photoconductor;

a charger;

an exposure device;

a developing device; and an image quality controller for detecting a factor concerning image quality and controlling image quality of an output image based on information about the factor, wherein a mother electrophotographic recording apparatus; and another electrophotographic recording apparatus are used for printing one job, and the image quality of the other another electrophotographic recording apparatus is controlled by the information of the mother electrophotographic recording apparatus.

3. An electrophotographic cluster printing system, comprising: a plurality of electrophotographic recording apparatuses, each of the plurality of electrophotographic recording apparatuses, including:

a photoconductor;

a charger;

an exposure device;

a developing device; and an image quality controller for detecting a factor concerning image quality and controlling image quality of an output image based on information about the factor, wherein the plurality of electrophotographic recording apparatuses are connected in a sequence, such that a mother electrophotographic recording apparatus comprises a first electrophotographic recording apparatus in the sequence, the image quality of the each succeeding electrophotographic recording apparatus in the sequence is controlled successively by the information of the mother electrophotographic recording apparatus and the information detected by a last electrophotographic recording apparatus in the sequence is compared with the information detected by the mother electrophotographic recording apparatus to thereby terminate a series of control sequences.

4. The electrophotographic cluster printing system according to claim 1, wherein the information comprises an amount of toner deposited on the photoconductor.

5. The electrophotographic cluster printing system according to claim 1, wherein a bias voltage of the developing device is controlled based on the information.

6. An electrophotographic cluster printing system, comprising:

a plurality of recording electrophotographic apparatuses, each of the plurality of electrophotographic recording apparatuses, including:

a photoconductor;

a charger;

an exposure device;

a developing device; and an image quality controller for detecting a factor concerning image quality and controlling image quality of an output image based on information about the factor, wherein at least two of the electrophotographic recording apparatuses are combined as a tandem type for printing one job, a single mother electrophotographic recording apparatus and another electrophotographic recording apparatus are used for printing one job, and the image quality of the another electrophotographic recording apparatus is controlled by the information of the single mother electrophotographic recording apparatus.

7. The electrophotographic cluster printing system according to claim 6, wherein the information is comprises an amount of toner deposited on the photoconductor.

8. The electrophotographic cluster printing system according to claim 6, wherein a bias voltage of the developing device is controlled based on the information.

9. An electrophotographic cluster printing system, comprising:

a plurality of electrophotographic recording apparatuses, each of the plurality of electrophotographic recording apparatuses including an imaging engine that detects a factor concerning image quality and controls the image quality of an output image based on information about the factor, wherein a first and a second recording apparatus are used for printing one job, and the image quality of the second electrophotographic recording apparatus is controlled by the information of the first electrophotographic recording apparatus.

10. A method of electrophotographic cluster printing for a plurality of electrophotographic recording apparatuses under a control sequence, comprising:

detecting a first deposited toner mass on a first electrophotographic recording apparatus;

starting an ordinary printing operation for the first electrophotographic recording apparatus; and sending the first deposited toner mass to a second electrophotographic recording apparatus as a target value.

11. A method of electrophotographic cluster printing according to claim 10, wherein the detecting occurs at a predetermined time.

12. A method of electrophotographic cluster printing according to claim 10, wherein the first deposited toner mass comprises a last of a series of first deposited toner masses.

13. A method of electrophotographic cluster printing according to claim 10, further comprising:

detecting a second deposited toner mass of the second electrophotographic recording apparatus; and if the second deposited toner mass is within an allowable variation range of the target value, starting the ordinary printing operation for the second electrophotographic recording apparatus.

14. A method of electrophotographic cluster printing according to claim 13, further comprising:

sending the target value to a third electrophotographic recording apparatus.

15. A method of electrophotographic cluster printing according to claim 14, further comprising:

detecting a third deposited toner mass of the third electrophotographic recording apparatus;

if the third deposited toner mass is within an allowable variation range of the target value, starting the ordinary printing operation for the third electrophotographic recording apparatus; and sending the third deposited toner mass to the first third electrophotographic recording apparatus.

16. A method of electrophotographic cluster printing according to claim 15, further comprising:

detecting another first deposited toner mass; and comparing the another first deposited toner mass to the third deposited toner mass.

17. A method of electrophotographic cluster printing according to claim 16, further comprising:

if the another first deposited toner mass and the third deposited toner mass are within an allowable difference, then ending the control sequence.

18. A method of electrophotographic cluster printing according to claim 16, further comprising:

if the another first deposited toner mass and the third deposited toner mass are not within an allowable difference, then initiating another control sequence.

* * * * *